US006492783B2

(12) United States Patent
Sakurai et al.

(10) Patent No.: US 6,492,783 B2
(45) Date of Patent: Dec. 10, 2002

(54) DEFLECTION YOKE AND CATHODE RAY TUBE DEVICE

(75) Inventors: Souichi Sakurai, Yokohama (JP); Nobuyuki Koganezawa, Chiba (JP); Nobutaka Okuyama, Yokohama (JP); Takeshi Kaneki, Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/910,215

(22) Filed: Jul. 20, 2001

(65) Prior Publication Data

US 2002/0101204 A1 Aug. 1, 2002

(30) Foreign Application Priority Data

Dec. 20, 2000 (JP) ..... 2000-391823

(51) Int. Cl.[7] ..... G09G 1/28

(52) U.S. Cl. ..... 315/368.28; 315/368.27; 315/368.25; 315/402; 315/399; 313/431; 313/440; 313/442

(58) Field of Search ..... 315/8, 368.11, 315/368.15, 368.25, 368.26, 368.27, 368.28, 370, 399, 402, 364; 313/412, 413, 421, 428, 431, 437, 409, 440, 442

(56) References Cited

U.S. PATENT DOCUMENTS 3,745,405 A * 7/1973 Fuse ..... 315/14
4,547,707 A * 10/1985 Yabase ..... 315/368.27
4,788,470 A * 11/1988 Kohzuki et al. ..... 313/440
5,070,280 A * 12/1991 Okuyama et al. ..... 313/412
5,548,190 A * 8/1996 Okuyama et al. ..... 315/368.26
5,793,165 A * 8/1998 Hayashi et al. ..... 315/370
6,166,484 A * 12/2000 Okuyama et al. ..... 313/431
6,215,257 B1 * 4/2001 Choe ..... 315/368.28

* cited by examiner

*Primary Examiner*—Haissa Philogene
(74) *Attorney, Agent, or Firm*—Townsend and Townsend and Crew LLP

(57) ABSTRACT

Horizontal line misconvergences produced at screen upper and lower portions, among rasters displayed by side electron beams are corrected without producing degradation in vertical deflection sensitivity so much and changing horizontal trapezoidal distortion. In a deflection yoke provided with a top-and-bottom pair of saddle-type horizontal deflection coils and a right-and-left pair of saddle-type deflection coils and mounted to and used in a color cathode ray tube having an in-line arranged electron gun, a pair of sub-cores is provided from side to side or above and below on the electron gun side of the deflection yoke. At least one pair of correction coils is wound around each of the pair of sub-cores. The one pair of correction coils is connected in series with vertical deflection coils in such a manner that respective magnetic poles produced from the one pair of correction coils become identical to the pole of a cathode ray tube axis, and a variable resistor is connected in parallel with the one pair of correction coils to change a current that flows through the one pair of correction coils.

10 Claims, 7 Drawing Sheets

DEFLECTION YOKE AND CATHODE RAY TUBE DEVICE

BACKGROUND OF THE INVENTION

1. Field of the Invention

The present invention relates to a deflection yoke mounted to and used in a color cathode ray tube having an in-line arranged electron gun.

2. Description of the Related Art

According to a prior art described in Unexamined Patent Publication No. Hei 9(1997)-17355, variable resistors are respectively parallel-connected to correction coils wound around intermediate legs of a pair of E-shaped cores to compensate for or correct horizontal trapezoidal distortion (lateral trapezoidal distortion) developed in a cathode ray tube device by a variable resistor parallel-connected to vertical deflection coils and improve horizontal line misconvergences (V tilts) produced at screen upper and lower portions, among rasters displayed by side electron beams produced upon the correction.

SUMMARY OF THE INVENTION

In the prior art, however, the correction coils needed to be connected in series with the vertical deflection coils so as to generate barrel-type magnetic fields lying in a direction opposite to a vertical deflection direction. Thus, vertical deflection sensitivity was degraded.

An object of the present invention is to provide a deflection yoke provided with means capable of correcting horizontal line misconvergences produced at screen upper and lower portions, among rasters displayed by side beams, without changing horizontal trapezoidal distortion because degradation in vertical deflection sensitivity, which presents a problem in the prior art, does not take place and magnetic fields lying in a direction opposite to a vertical deflection direction are not produced, and a cathode ray tube device using the same.

Therefore, the present invention provides a deflection yoke comprising at least a vertical pair of saddle-type horizontal deflection coils, and a horizontal pair of saddle-type deflection coils, and mounted to and used in a color cathode ray tube having an in-line arranged electron gun, wherein a pair of sub-cores is provided on the electron gun side of the deflection yoke from side to side or up and down, at least one pair of correction coils is wound around each of the pair of sub-cores, the one pair of correction coils is connected in series with vertical deflection coils so that respective magnetic poles produced from the one pair of correction coils become identical to the pole of a cathode ray tube axis, and a variable resistor is connected in parallel with the one pair of correction coils to change a current that flows through the one pair of correction coils.

According to the deflection yoke of the present invention, a color cathode ray tube device can be obtained which is capable of independently correcting horizontal line misconvergences produced at screen upper and lower portions without virtually degrading vertical deflection sensitivity owing to the provision of the two pairs of correction coils in the above-described construction and which is free of horizontal trapezoidal distortion and the horizontal line misconvergences at the screen upper and lower portions by utilizing such correction in combination with the correction of the horizontal trapezoidal distortion produced by a variable resistor connected in parallel with the vertical deflection coils.

BRIEF DESCRIPTION OF THE DRAWINGS

These and other features, objects and advantages of the present invention will become more apparent from the following description when taken in conjunction with the accompanying drawings wherein.

DETAILED DESCRIPTION OF THE PREFERRED EMBODIMENTS

Preferred embodiments of the present invention will hereinafter be described with reference to the accompanying drawings.

Figure 1:
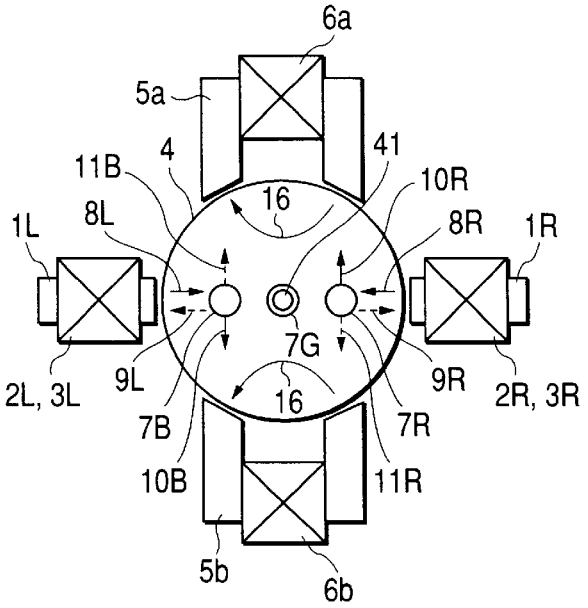
FIG. 1 is a configuration diagram as viewed from the luminescent screen side, showing an essential part of a deflection yoke according to a first embodiment of the present invention.
Figure 2:
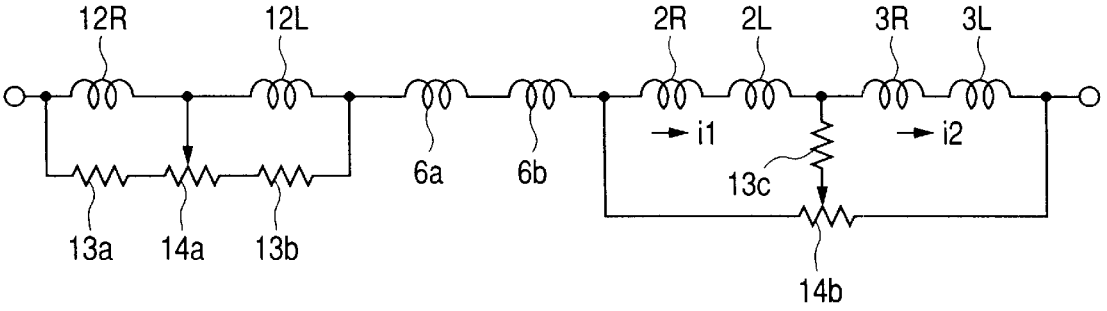
FIG. 2 is a connection diagram on the vertical deflection coil side, showing the deflection yoke shown in FIG. 1.

FIGS. 1 and 2 show a first embodiment of the present invention, wherein FIG. 1 is a diagram as viewed from the luminescent screen side, showing an essential part of a deflection yoke according to the present invention, and FIG. 2 is a connection diagram on the vertical deflection coil side. On the electron gun side of the deflection yoke, a first pair of sub-cores 1L and 1R is provided from side to side and a second pair of sub-cores 5*a* and 5*b* is provided at the top and bottom, with a neck portion 4 of a color cathode ray tube interposed therebetween as shown in FIG. 1. The first pair of sub-cores 1L and 1R is I-shaped soft ferrites long in the horizontal direction. Two sets of correction coils 2L, 2R and 3L, 3R are wound around their corresponding sub-cores 1L and 1R.

On the other hand, the second pair of sub-cores 5*a* and 5*b* is U-shaped soft ferrites. Auxiliary vertical deflection coils 6*a* and 6*b* are wound around their corresponding sub-cores 5*a* and 5*b*.

Figure 3A:
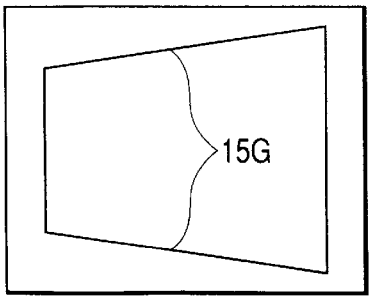
FIG. 3A is a diagram showing horizontal trapezoidal distortion.
Figure 3B:
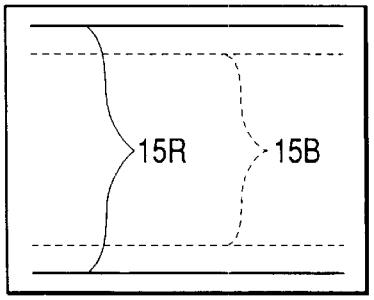
FIG. 3B is a diagram illustrating horizontal line misconvergences at screen upper and lower portions.

As indicated by a circuit diagram of FIG. 2, a pair of saddle-type vertical deflection coils 12R and 12L, the auxiliary vertical deflection coils 6*a* and 6*b*, the first pair of correction coils 2R and 2L, and the second pair of correction coils 3R and 3L are sequentially connected in series. Further, resistors 13*a* and 13*b* and a variable resistor 14*a* are connected in parallel with the pair of saddle-type vertical deflection coils 12R and 12L. Adjusting the variable resistor 14*a* makes it possible to change the horizontal trapezoidal distortion shown in FIG. 3A and the horizontal line misconvergences at the upper and lower portions of the screen, which are shown in FIG. 3B. In the respective drawings, reference numerals 15G indicate green rasters displayed on a luminescent screen by a center electron beam 7G, and reference numerals 15R and 15B indicate red and blue rasters displayed on the luminescent screen by side electron beams 7R and 7B.

A variable resistor 14*b* is connected in parallel with the correction coils 2R, 2L, 3R and 3L. A resistor 13*c* is connected between a point where the correction coils 2L and 3R are connected, and a variable terminal of the variable resistor 14*b*. The variable resistor 14*b* is adjusted to thereby allow an adjustment to the ratio between a current i1 that flows through the first pair of correction coils 2R and 2L and a current i2 that flows through the second pair of correction coils 3R and 3L. Owing to the current i1, the first pair of correction coils 2R and 2L generates magnetic fields 8R and 8L directed toward an axis 41 of the cathode ray tube, and their magnetic poles are identical to one another. On the other hand, the second pair of correction coils 3R and 3L generates magnetic fields 9R and 9L lying in a direction to be emitted from the cathode ray tube axis 41, by means of the current i2. Respective magnetic poles of the magnetic fields 9R and 9L are formed so as to become identical while they are different from those of the magnetic fields 8R and 8L. Therefore, deflecting forces 10R and 10B act on the side electron beams 7R and 7B depending on i1. On the other hand, deflecting forces 11R and 11B act on the side electron beams 7R and 7B depending on i2.

Thus, when the variable resistor 14*a*, 14*b* is adjusted to make i2 larger than i1, the horizontal line misconvergences at the screen upper and lower portions such as shown in FIG. 3B can be corrected without changing the horizontal trapezoidal distortion. Since the correction coils 2R, 2L, 3R and 3L produce no backward vertical deflection magnetic components, degradation in vertical deflection sensitivity is less reduced.

Further, the auxiliary vertical deflection coils 6*a* and 6*b* are ones for forming pin cushion-type magnetic fields 16 within the cathode ray tube 4 as is well known and for correcting frame aberration.

The configuration shown in FIG. 1 has the merit that since the sub-cores 5*a* and 5*b* each comprised of the soft ferrite are placed above and below, the magnetic fields 8R, 8L, 9R and 9L produced from the sub-cores 1L and 1R are capable of implementing high sensitivity.

Figure 4:
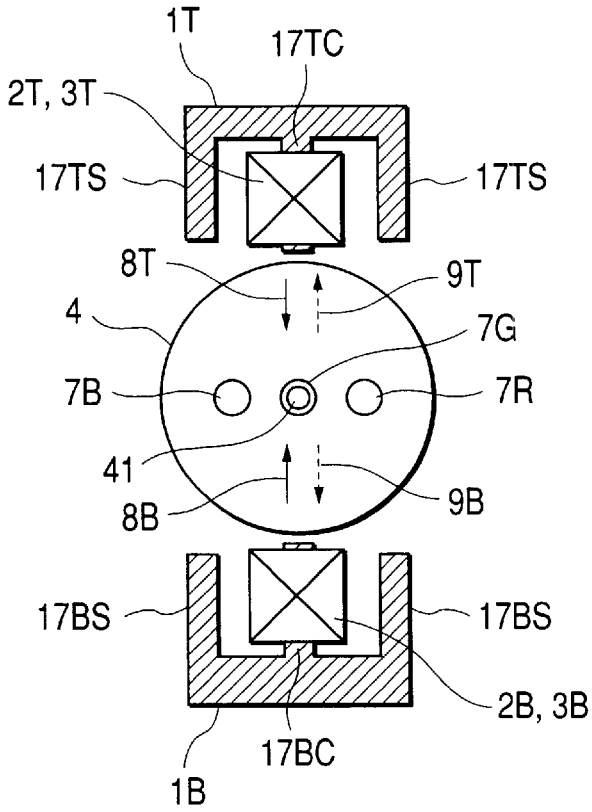
FIG. 4 is a configuration diagram as viewed from the luminescent screen side, illustrating an essential part of a deflection yoke according to a second embodiment of the present invention.

FIG. 4 is a diagram showing a second embodiment of the present invention. Parts each having a function similar to FIG. 1 are respectively represented with symbols similar to FIG. 1. A large feature of FIG. 4 resides in that a vertical or top-and-bottom pair of sub-cores is E-shaped. In FIG. 4, the present embodiment has a central leg 17TC and both side legs 17TS of an upper E-shaped core 1T extending to a cathode ray tube axis 41, and a central leg 17BC and both side legs 17BS of a lower E-shaped core 1B extending thereto. A first pair of correction coils 2T and 2B and a second pair of correction coils 3T and 3B are respectively wound around the central legs 17TC and 17BC. The operation of the present invention is identical to the contents described in FIGS. 1 through 3. Namely, the first pair of correction coils 2T and 2B produces magnetic fields 8T and 8B directed toward the cathode ray tube axis 41, and their magnetic poles are identical to one another. On the other hand, the second pair of correction coils 3T and 3B produces magnetic fields 9T and 9B lying in a direction to be emitted from the cathode ray tube axis 41. While respective magnetic poles of the magnetic fields 9T and 9B are different from those of the magnetic fields 8T and 8B, they are formed so as to be identical to each other. While the two pairs of correction coils are provided in FIG. 4, it is needless to say that even if one pair of correction coils or three or more pairs of correction coils are used, they act in a manner similar to the above.

Figure 5:
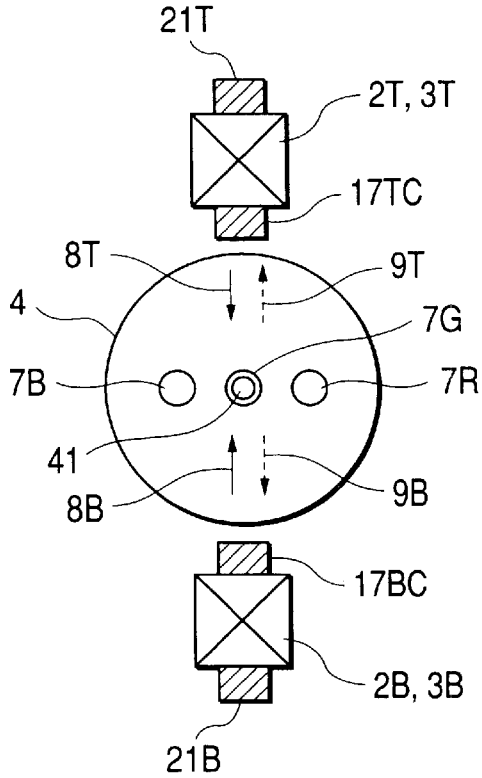
FIG. 5 is a configuration diagram as viewed from the luminescent screen side, depicting an essential part of a deflection yoke according to a third embodiment of the present invention.

FIG. 5 is a diagram showing a third embodiment of the present invention. Parts each having a function similar to FIG. 1 are respectively represented with symbols similar to FIG. 1. A large feature of FIG. 5 resides in that a pair of sub-cores placed above and below is I-shaped. In FIG. 5, the present embodiment has a central leg 17TC of an upper I-shaped core 21T extending to a cathode ray tube axis 41, and a central leg 17BC of a lower I-shaped core 21B extending thereto. A first pair of correction coils 2T and 2B and a second pair of correction coils 3T and 3B are wound around their corresponding central legs 17TC and 17BC. The operation of the present invention is identical to the contents described in FIGS. 1 through 3. Namely, the first pair of correction coils 2T and 2B produces magnetic fields 8T and 8B directed to the cathode ray tube axis 41, and their magnetic poles are identical to one another. On the other hand, the second pair of correction coils 3T and 3B produces magnetic fields 9T and 9B lying in a direction to be emitted from the cathode ray tube axis 41. While respective magnetic poles of the magnetic fields 9T and 9B are different from those of the magnetic fields 8T and 8B, they are formed so as to be identical to each other. While the two pairs of correction coils are provided in FIG. 5, it is needless to say that even if one pair of correction coils or three or more pairs of correction coils are used, they act in a manner similar to the above.

Figure 6:
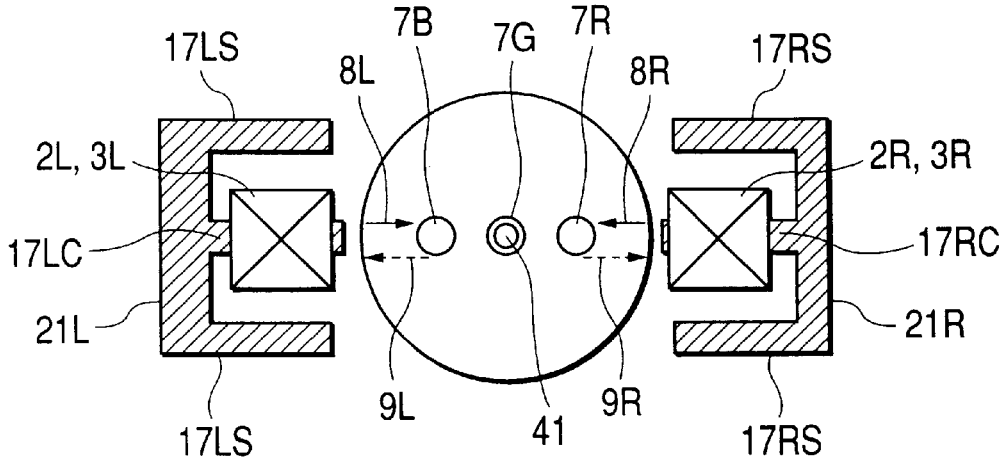
FIG. 6 is a configuration diagram as viewed from the luminescent screen side, showing an essential part of a deflection yoke according to a fourth embodiment of the present invention.

FIG. 6 is a diagram showing a fourth embodiment of the present invention. Parts each having a function similar to FIG. 1 are respectively represented with symbols similar to FIG. 1. A large feature of FIG. 6 resides in that a horizontal or right-and-left pair of sub-cores is E-shaped. In FIG. 6, the present embodiment has a central leg 17RC of a right E-shaped core 21R extending to a cathode ray tube axis 41, and a central leg 17LC of a left E-shaped core 21L extending thereto. A first pair of correction coils 2R and 2L and a second pair of correction coils 3R and 3L are wound around their corresponding central legs 17RC and 17LC. The operation of the present invention is identical to the contents described in FIGS. 1 through 3. Namely, the first pair of correction coils 2R and 2L produces magnetic fields 8R and 8 directed to the cathode ray tube axis 41, and their magnetic poles are identical to one another. On the other hand, the second pair of correction coils 3R and 3L produces magnetic fields 9R and 9L lying in a direction to be emitted from the cathode ray tube axis 41. While respective magnetic poles of the magnetic fields 9R and 9L are different from those of the magnetic fields 8R and 8L, they are formed so as to be identical to each other. While the two pairs of correction coils are provided in FIG. 6, it is needless to say that even if one pair of correction coils or three or more pairs of correction coils are used, they act in a manner similar to the above.

Figure 7:
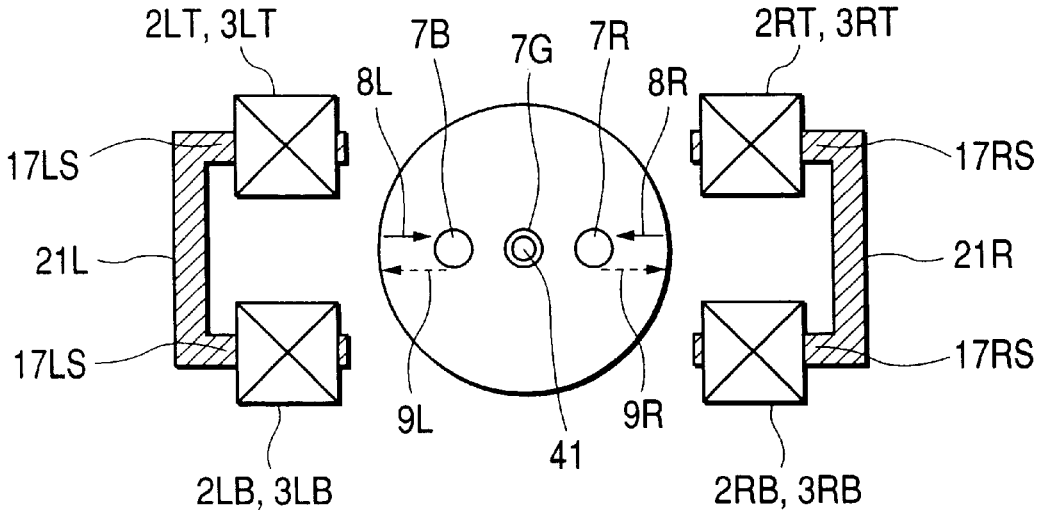
FIG. 7 is a configuration diagram as viewed from the luminescent screen side, illustrating an essential part of a deflection yoke according to a fifth embodiment of the present invention.

FIG. 7 is a diagram showing a fifth embodiment of the present invention. Parts each having a function similar to FIG. 1 are respectively represented with symbols similar to FIG. 1. A large feature of FIG. 7 resides in that a pair of sub-cores placed from side to side is inverted U-shaped. In FIG. 7, the present embodiment has a side leg 17RS of a right inverted U-shaped core 21R extending to a cathode ray tube axis 41, and a side leg 17LS of a left inverted U-shaped core 21L extending thereto. First pairs of correction coils 2RT, 2LT, 2RB and 2LB and second pairs of correction coils 3RT, 3LT, 3RB and 3LB are wound around their corresponding legs. The operation of the present invention is identical to the contents described in FIGS. 1 through 3. Namely, the first pairs of correction coils 2RT, 2LT, 2RB and 2LB respectively produce magnetic fields 8R and 8L directed to the cathode ray tube axis 41, and their magnetic poles are identical to one another. On the other hand, the second pairs of correction coils 3RT, 3LT, 3RB and 3LB respectively produce magnetic fields 9R and 9L lying in a direction to exit from the cathode ray tube axis 41. While respective magnetic poles of the magnetic fields 9R and 9L are different from those of the magnetic fields 8R and 8L, they are formed so as to be identical to each other.

Figure 8:
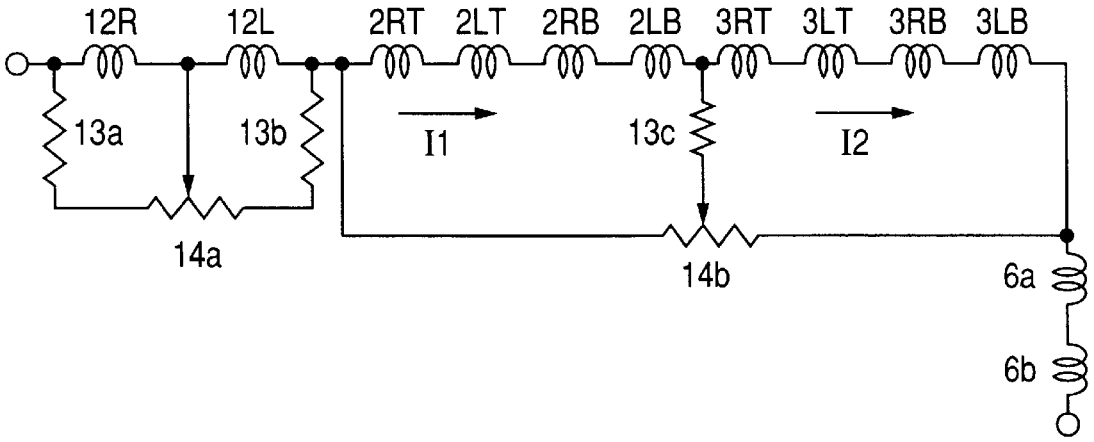
FIG. 8 is a connection diagram on the vertical deflection coil side, showing the deflection yoke shown in FIG. 7.

FIG. 8 shows a circuit diagram of the correction coils 2RT, 2LT, 2RB, 2LB and 3RT, 3LT, 3RB and 3LB shown in FIG. 7. In the same drawing, a variable resistor 14*b* is connected in parallel with the correction coils 2RT, 2LT, 2RB, 2LB and 3RT, 3LT, 3RB and 3LB. A resistor 13*c* is connected between a point where the correction coils 2LB and 3RT are connected, and a variable terminal of the variable resistor 14*b*. The variable resistor 14*b* is adjusted to thereby allow an adjustment to the ratio between a current i1 that flows through the first pairs of correction coils 2RT, 2LT, 2RB and 2LB and a current i2 that flows through the second pairs of correction coils 3RT, 3LT, 3RB and 3LB. While the two pairs of correction coils are provided in FIG. 7, it is needless to say that even if one pair of correction coils or three or more pairs of correction coils are used, they act in a manner similar to the above.

Figure 9:
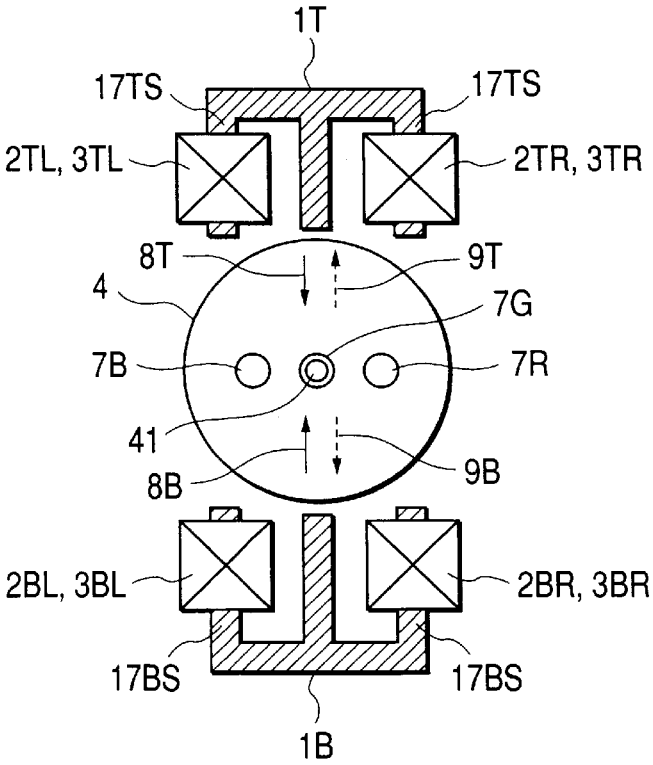
FIG. 9 is a configuration diagram as viewed from the luminescent screen side, showing an essential part of a deflection yoke according to a sixth embodiment of the present invention.
Figure 10:
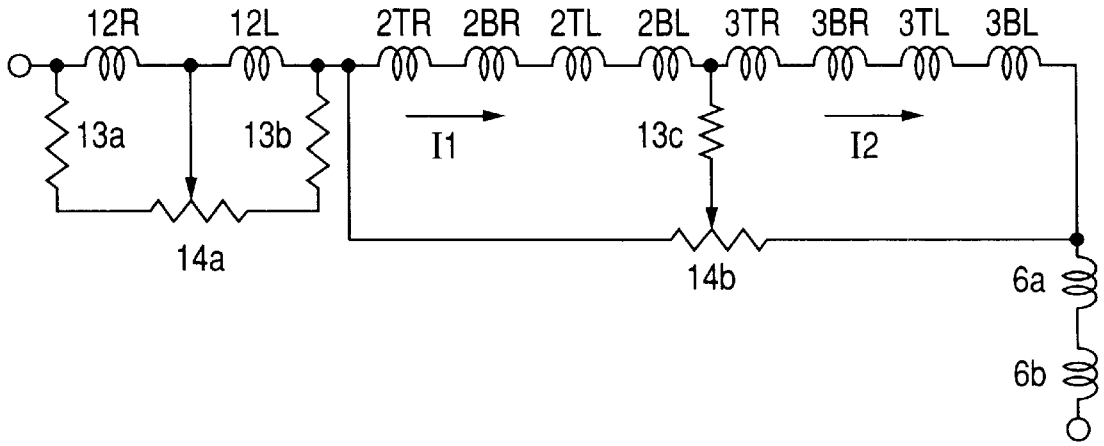
FIG. 10 is a connection diagram on the vertical deflection coil side, illustrating the deflection yoke shown in FIG. 9.

FIG. 9 is a diagram showing a sixth embodiment of the present invention. Parts each having a function similar to FIG. 4 are respectively represented with symbols similar to FIG. 4. A large feature of FIG. 9 resides in that a top-and-bottom pair of sub-cores is E-shaped and both side legs are provided with correction coils. First pairs of correction coils 2TR, 2BR, 2TL and 2BL and second pairs of correction coils 3TR, 3BR, 3TL and 3BL are wound around their corresponding side legs 17TS and 17BS. The operation of the present invention is identical to the contents described in FIG. 4. Namely, the first pairs of correction coils 2TR, 2BR, 2TL and 2BL respectively produce magnetic fields 8T and 8B directed to a cathode ray tube axis 41, and their magnetic poles are identical to one another. On the other hand, the second pairs of correction coils 3TR, 3TL, 3BR and 3BL respectively produce magnetic fields 9T and 9B lying in a direction to exit from the cathode ray tube axis 41. While respective magnetic poles of the magnetic fields 9T and 9R are different from those of the magnetic fields 8T and 8B, they are formed so as to be identical to each other. FIG. 10 shows a circuit diagram of the correction coils 2TR, 2BR, 2TL, 2BL and 3TR, 3BR, 3TL and 3BL shown in FIG. 9. In the same drawing, a variable resistor 14*b* is connected in parallel with the correction coils 2TR, 2BR, 2TL, 2BL and 3TR, 3BR, 3TL and 3BL. A resistor 13*c* is connected between a point where the correction coils 2BL and 3TR are connected, and a variable terminal of the variable resistor 14*b*. The variable resistor 14*b* is adjusted to thereby allow an adjustment to the ratio between a current i1 that flows through the first pairs of correction coils 2TR, 2BR, 2TL and 2BL and a current i2 that flows through the second pairs of correction coils 3TR, 3TL, 3BR and 3BL. While the two pairs of correction coils are provided in FIG. 9, it is needless to say that even if one pair of correction coils or three or more pairs of correction coils are used, they act in a manner similar to the above.

Figure 11:
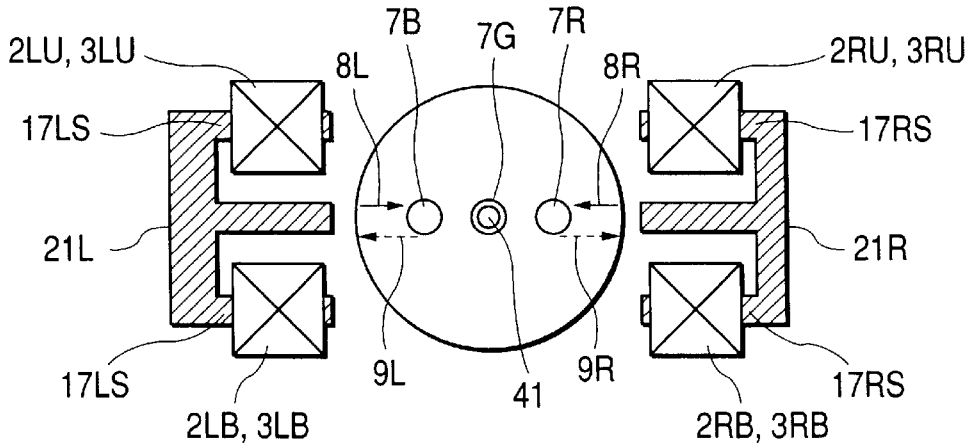
FIG. 11 is a configuration diagram as viewed from the luminescent screen side, showing an essential part of a deflection yoke according to a seventh embodiment of the present invention.

FIG. 11 a diagram showing a seventh embodiment of the present invention. Parts each having a function similar to FIG. 7 are respectively represented with symbols similar to FIG. 7. A large feature of FIG. 11 resides in that a right-and-left pair of sub-cores is E-shaped. IN FIG. 11, first pairs of correction coils 2RU, 2LU, 2RB and 2LB and second pairs of correction coils 3RU, 3LU, 3RB and 3LB are wound around their corresponding side legs 17RS and 17LS. The operation of the present invention is identical to the contents described in FIG. 7. Namely, the first pairs of correction coils 2RU, 2LU, 2RB and 2LB respectively produce magnetic fields 8R and 8L directed to a cathode ray tube axis 41, and their magnetic poles are identical to one another. On the other hand, the second pairs of correction coils 3RU, 3LU, 3RB and 3LB respectively produce magnetic fields 9R and 9L lying in a direction to exit from the cathode ray tube axis 41. While respective magnetic poles of the magnetic fields 9R and 9L are different from those of the magnetic fields 8R and 8L, they are formed so as to be identical to one another. A connection diagram of the correction coils shown in FIG. 11 is similar to the circuit diagram shown in FIG. 8. While the two pairs of correction coils are provided in FIG. 11, it is needless to say that even if one pair of correction coils or three or more pairs of correction coils are used, they act in a manner similar to the above.

Figure 14:
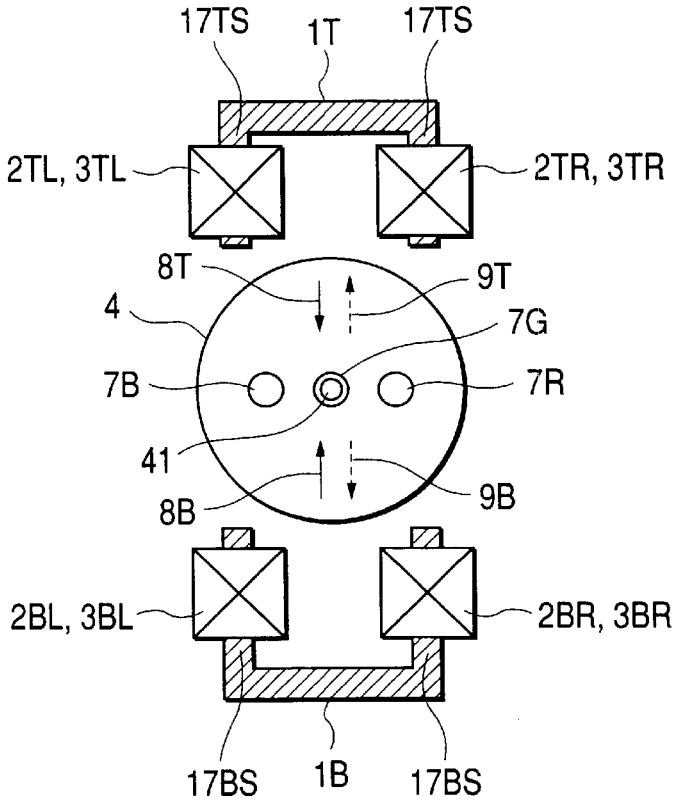
FIG. 14 is a configuration diagram as viewed from the luminescent screen side, showing an essential part of a deflection yoke according to an eighth embodiment of the present invention.

FIG. 14 is a diagram showing an eighth embodiment of the present invention. Parts each having a function similar to FIG. 4 are respectively represented with symbols similar to FIG. 4. A large feature of FIG. 14 resides in that a pair of sub-cores disposed above and below is inverted U-shaped and both side legs are provided with correction coils. First pairs of correction coils 2TR, 2BR, 2TL and 2BL and second pairs of correction coils 3TR, 3BR, 3TL and 3BL are wound around their corresponding side legs 17TS and 17BS. The operation of the present invention is identical to the contents described in FIG. 4.

Namely, the first pairs of correction coils 2TR, 2BR, 2TL and 2BL respectively produce magnetic fields 8T, 8B directed to a cathode ray tube axis 41, and their magnetic poles are identical to another other. On the other hand, the second pairs of correction coils 3TR, 3TL, 3BR and 3BL respectively produce magnetic fields 9T and 9B lying in a direction to exit from the cathode ray tube axis 41. While respective magnetic poles of the magnetic fields 9T and 9B are different from those of the magnetic fields 8T and 8B, they are formed so as to be identical to one another. While auxiliary vertical deflection coils 6*a* and 6*b* are not shown in FIGS. 4 through 7, FIG. 9, FIG. 11 and FIG. 14, they are placed in a manner similar to the contents shown in FIG. 1. The auxiliary vertical deflection coils 6*a* and 6*b* form pin cushion-type magnetic fields within a cathode ray tube 4 to correct frame aberration.

Figure 15:
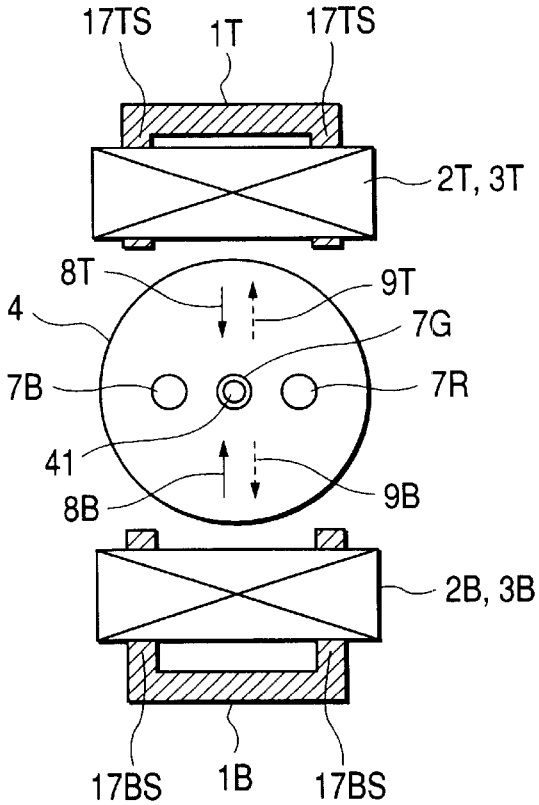
FIG. 15 is a configuration diagram as viewed from the luminescent screen side, illustrating the essential part of the deflection yoke according to the eighth embodiment of the present invention.

FIG. 15 is characterized in that in the invention shown in FIG. 14, first pairs of correction coils 2T, 3T and second pairs of correction coils 2B and 3B are placed so as to wrap right-and-left side legs 17TS and 17BS, and has the merit of capable of reducing the number of correction coils. The operation of the invention shown in FIG. 15 is similar to the contents described in FIGS. 14 and 4.

Figure 12:
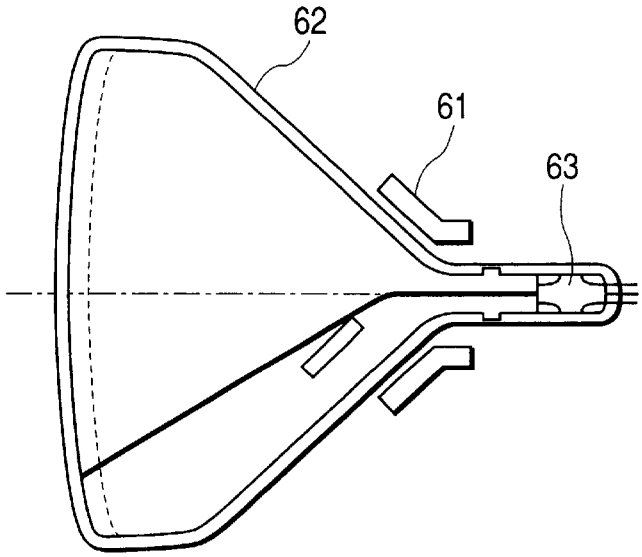
FIG. 12 is a diagram showing a cathode ray tube equipped with a deflection yoke according to the present invention.

FIG. 12 is a diagram showing a cathode ray tube equipped with the deflection yoke described in the present invention shown in each of FIGS. 1 through 11.

Figure 13:
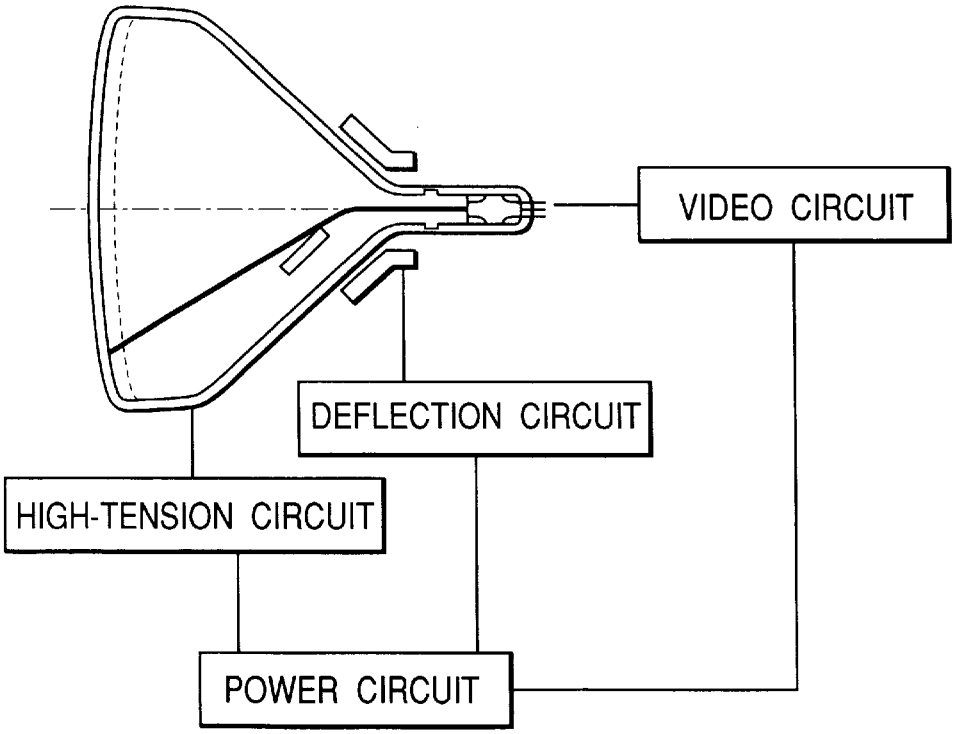
FIG. 13 is a diagram illustrating a cathode ray tube device equipped with a deflection yoke or a cathode ray tube according to the present invention.

FIG. 13 is a diagram showing a cathode ray tube device equipped with the deflection yoke or the cathode ray tube described in the present invention shown in each of FIGS. 1 through 12.

While we have shown and described several embodiments in accordance with our invention, it should be understood that disclosed embodiments are susceptible of changes and modifications without departing from the scope of the invention. Therefor, we do not intend to be bound by the details shown and described herein but intended to cover all such changes and modifications as to fall within the ambit of the appended claims.

We claim:

1. A deflection yoke comprising:

a top-and-bottom pair of deflection coils; and a right-and-left pair of deflection coils, said deflection yoke being mounted to and used in a color cathode ray tube having an in-line arranged electron gun, wherein a pair of sub-cores is provided on the electron gun side of said deflection yoke from side to side or above and below, at least one pair of correction coils is wound around each of the pair of sub-cores, said at least one pair of correction coils is connected in series with vertical deflection coils so that respective magnetic poles produced from said at least one pair of correction coils become identical to the pole of a cathode ray tube axis, and a variable resistor is connected in parallel with said at least one pair of correction coils to change a current that flows through said at least one pair of correction coils.

2. The deflection yoke according to claim 1, wherein said right-and-left pair of sub-cores is a pair of I-shaped soft ferrites and long in the horizontal direction, said top-and-bottom pair of sub-cores is a pair of U-shaped soft ferrites and long in the vertical direction, said right-and-left pair of sub-cores includes at least one pair of correction coils wound therearound, said at least one pair of correction coils is connected in series with vertical deflection coils so that respective magnetic poles produced from said at least one pair of correction coils become identical to the pole of a cathode ray tube axis, and said top-and-bottom pair of sub-cores includes auxiliary vertical deflection coils wound therearound.

3. The deflection yoke according to claim 1 or 2, wherein two pairs of correction coils are wound around said right-and-left pair of sub-cores, and respective magnetic poles produced from the two pairs of correction coils cause vertical deflection currents to flow so that they are different in poles from one another.

4. The deflection yoke according to claim 1, wherein said top-and-bottom pair of sub-cores is a pair of E-shaped soft ferrites whose legs extend to a cathode ray tube axis or a pair of I-shaped soft ferrites long in the vertical direction.

5. The deflection yoke according to claim 1, wherein said right-and-left pair of sub-cores is E-shaped soft ferrites whose legs extend to a cathode ray tube axis or inverted U-shaped soft ferrites whose legs extend to the cathode ray tube axis.

6. The deflection yoke according to claim 4, wherein at least one pair of correction coils is wound around either central legs or both side legs of said top-and-bottom pair of E-shaped sub-cores, and said at least one pair of correction coils is connected in series with vertical deflection coils so that respective magnetic poles produced from said at least one pair of correction coils become identical to the pole of a cathode ray tube axis.

7. The deflection yoke according to claim 4, wherein at least one pair of correction coils is wound around both side legs of said top-and-bottom pair of inverted U-shaped sub-cores, and said at least one pair of correction coils is connected in series with vertical deflection coils so that respective magnetic poles produced from said at least one pair of correction coils become identical to the pole of a cathode ray tube axis.

8. The deflection yoke according to claim 5, wherein at least one pair of correction coils is wound around either central legs or both side legs of said right-and-left pair of E-shaped sub-cores, and said at least one pair of correction coils is connected in series with vertical deflection coils so that respective magnetic poles produced from said at least one pair of correction coils become identical to the pole of a cathode ray tube axis.

9. A cathode ray tube device using any of the deflection yokes according to claims 1 to 8.

10. A cathode ray tube display device using any of the deflection yokes according to claims 1 to 8.

* * * * *